US006058868A

United States Patent [19]

Kyle et al.

[11] Patent Number: 6,058,868

[45] Date of Patent: May 9, 2000

[54] FURLING ELEMENT

[75] Inventors: James H. Kyle; Michael Haber; Kenneth Clark, all of Charlestown, N.H.

[73] Assignee: Pompanette, Inc., Charlestown, N.H.

[21] Appl. No.: 09/128,681

[22] Filed: Aug. 4, 1998

Related U.S. Application Data

[60] Provisional application No. 60/078,683, Mar. 20, 1998.

[51] Int. Cl.[7] ..... B63H 9/10

[52] U.S. Cl. ..... 114/106; 114/107; 403/312

[58] Field of Search ..... 114/104–107; 403/310, 312, 313

[56] References Cited

U.S. PATENT DOCUMENTS

| | | | |
|---|---|---|---|
| 3,927,633 | 12/1975 | Bernard | 114/105 |
| 4,573,424 | 3/1986 | Clausin | 114/106 |
| 4,723,499 | 2/1988 | Furgang | 114/106 |

FOREIGN PATENT DOCUMENTS

| | | | |
|---|---|---|---|
| 0 002 603 | 6/1979 | European Pat. Off. | 114/104 |

*Primary Examiner*—Sherman Basinger
*Attorney, Agent, or Firm*—Dougherty & Troxell

[57] ABSTRACT

A roller furling element for installation on a head stay of a sail boat, the element including two longitudinally extending hollow outer extrusions in an end-to-end abutting relationship. A two piece splice assembly joins the extrusions together and provides the torsional strength needed for a furling element. The two piece splice assembly includes a central axis and a longitudinally extending forward or nose portion having a curved outer surface and rearwardly extending projections each including a longitudinally extending groove. A tail piece includes a pair of longitudinally extending outwardly extending projections which are adapted to fit into the parallel notches in the forward portion. A transverse passageway extends into the nose and tail portions when the two portions are aligned so that a rod or button can be inserted.

24 Claims, 3 Drawing Sheets

FURLING ELEMENT

RELATED APPLICATIONS

This application is a continuation of U.S. Provisional Application, Ser. No. 60/078,683 filed on Mar. 20, 1998.

FIELD OF THE INVENTION

This invention relates to a furling element for a jib sail or the like and more particularly to a furling element which includes a split splice assembly.

BACKGROUND FOR THE INVENTION

Roll furling systems, for wrapping a jib sail about a longitudinally extending element are well known. For example, a roll furler for a jib sail is disclosed in the Hood U.S. Pat. No. 4,248,281 which is incorporated herein in its entirety by reference. As disclosed therein, a torsionally stiff luff element is provided which is grooved over a major central portion of its length for receiving the luff bead of a jib sail. At the bottom of the luff element, means are provided for rotating the element to wrap a jib sail about the element.

More recent roller furlers utilize six foot aluminum extrusions along the head stay that the sail slides on. These aluminum extrusions are then spliced together and cut to vary in size depending on the final length of the assembled extrusions and the size of the boat. In such furlers, the extrusions need to remain centered on the head stay in order to rotate smoothly under load. This requires that the extrusions incorporate a small diameter center hole or passageway which is not much larger than the wire head stay.

In conventional designs, the small diameter center hole is included in a splice piece which is used to splice the six foot extrusions together. Such splice pieces are typically 12 inch long aluminum extrusions that have a small center hole. These 12" splice pieces then slip relatively snugly inside of the outer (6 ft.) aluminum extrusions. A mechanical fastener such as a screw is used to make the connections between the splice and the outer extrusions. To assemble the furling element, the splice piece or pieces must be slipped over the head stay wire. Therefore, it is common practice to cut the end fitting off the wire to allow the splice or splices to be slid over the wire. A new end fitting is then put on the wire.

More recently, Hood Yacht Systems of Tampa, Fla. manufactures and sells a split splice piece for joining the aluminum extrusions together to thereby form the furling element. These splice pieces, which are referred to as the "SL" series, include a molded luff bearing at every splice. In view of a need for a small center hole in each aluminum extrusion, a small center hole is placed in the luff bearings. This centers the extrusions on the head stay. The splice is split in two halves and both halves are mechanically fastened to the outer extrusions.

It is presently believed that there may be a large commercial market for an improved furling element which includes a two piece splice assembly in accordance with the present invention. It is believed that there is a demand for such elements because they will withstand the torsional loads imposed by the rotation of the furling element i.e. the outer extrusions. In addition, the splice assemblies in accordance with the present invention overcome a problem which is associated with securing the two halves of the splice assembly together. Because it is often preferred to include two slots in the trailing edge of an outer extrusion, an alternative to passing mechanical fasteners through both splice pieces is needed.

The furling element in accordance with the present invention provides the needed torsional rigidity after installation, is relatively inexpensive to manufacture, relatively easy to install and overcomes any need to remove and replace the end fittings of the head stay.

BRIEF SUMMARY OF THE INVENTION

In essence, the present invention contemplates a roller furling element for installation on a head stay of a sail boat. The element includes two longitudinally extending hollow outer extrusions, preferably of aluminum in an end-to-end abutting relationship. A two piece splice assembly joins or holds the extrusions together and provides the torsional strength needed for a furling element. The two piece splice assembly also defines a relatively small center passageway which is parallel with the axis of the longitudinally extending outer extrusions and through 360°, fully encloses the headstay wire. The passageway provides a bearing surface which allows the furling element to smoothly rotate about the head stay.

The split splice assembly in accordance with a preferred embodiment of the present invention includes a central axis and a longitudinally extending forward or nose portion having a curved outer surface which is generally similar to the leading edge of an aircraft wing. The nose portion also includes a longitudinally extending inner bearing surface which defines a semicircle and a pair of rearwardly extending projections. The inner bearing surface is adjacent to the head stay. The longitudinally extending semicircular bearing surface and rearwardly extending projections form a generally U-shaped cross section. The rearwardly extending projections each include a longitudinally extending groove or notch which is adjacent to the bearing surface and parallel to the central axis of the two piece splice assembly. These grooves, in the rearwardly extending projections, are constructed and arranged in a face to face or confronting relationship.

The split splice assembly also includes a longitudinally extending tail portion which defines a longitudinally extending bearing surface on an inner portion thereof i.e. that portion which engages the wire of a head stay. The tail piece also includes a pair of longitudinally extending outwardly extending projections or flanges which are adapted to fit into the parallel notches in the forward portion in sliding engagement therewith. A transverse passageway extends into the nose and tail portions when the two portions are aligned so that a rod or button can be inserted therein. This rod or button prevents longitudinal movement of the tail portion with respect to the forward or nose portion of the assembly. This rod or button is also held in place when an outer extrusion is forced over the splice assembly. A plurality of screws are then used to fix the forward portion of the splice assembly to each of the abutting extrusions.

The invention will now be described in connection with the accompanying drawings wherein like reference numerals have been used to designate like parts.

DETAILED DESCRIPTION OF THE PREFERRED EMBODIMENT OF THE INVENTION

Figure 1:
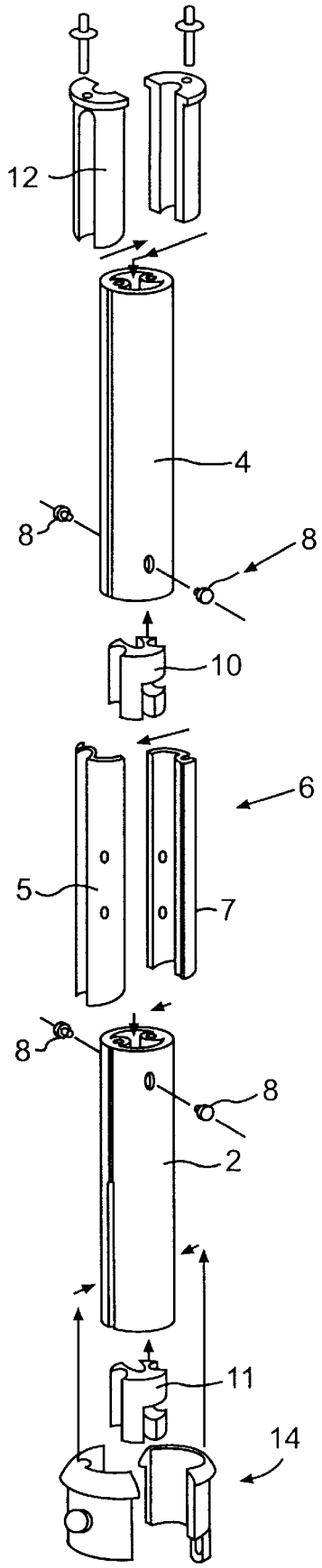
FIG. 1 (PRIOR ART)
FIG. 1 is an exploded view of a prior art furling element.

A prior art furling element is shown in FIG. 1 and includes a pair of outer extrusions 2 and 4 and a split splice assembly 6. The split splice assembly 6 includes two pieces 5 and 7. The two pieces 5 and 7 of splice assembly 6 are constructed and arranged to slide into the extrusions 2 and 4 and are held in place therein by a plurality of screws 8. The furling element also includes luff bearings 10 and 11 for positioning the furling element on a wire head stay (not shown). The furling element also includes a two piece top bearing 12 and a lower tack socket 14.

Figure 2:
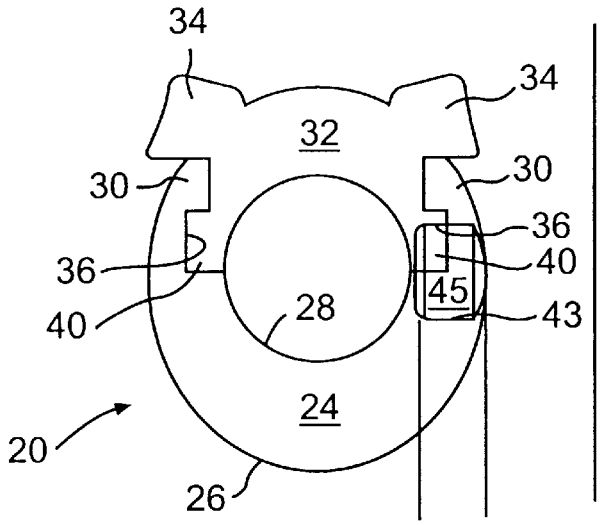
FIG. 2 is a cross sectional view which shows a split splice piece in accordance with the invention without cross hatching.
Figure 2A:
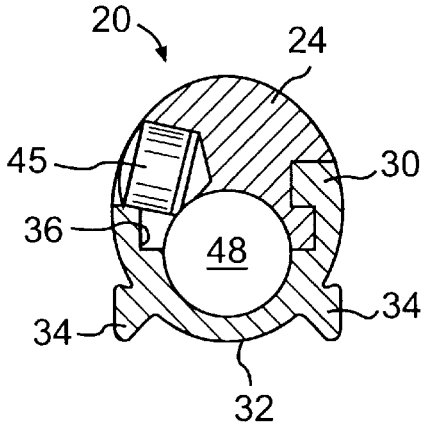
FIG. 2*a* is a cross sectional view which shows a split splice piece in accordance with the invention with cross hatching.

A furling element in accordance with a preferred embodiment of the present invention will now be described in connection with FIGS. 2–5. As illustrated in FIG. 2, a longitudinally extending splice assembly 20 (shown in cross section) is made from an aluminum extrusion and is preferably about 12 inches in length. The assembly 20 includes a forward or nose portion 24 which has a curved outer surface 26. The nose portion 24 has a generally rounded or aerodynamic shape on its forward side. The nose portion 24 also includes a longitudinally extending semicircular bearing surface 28 which is adapted to engage a wire headstay (not shown) for rotation thereabout. The portion 24 also includes a pair of rearwardly extending projections 30 which together with the semicircular bearing surface 28 provide a generally U-shaped cross section. When the nose portion 24 is joined together with a tail portion 32, the split splice assembly 20 forms a generally oval shaped cross section with a pair of longitudinally extending ears 34 and a central circular passageway 48 for loosely engaging the headstay (not shown).

The nose portion 24 also includes a pair of longitudinally extending notches or grooves 36 with one of the grooves 36 in each of the projections 30. The grooves 36 are adjacent to the bearing surface 28 and in a facing or confronting arrangement. The longitudinally extending tail piece 32 also includes a pair of longitudinally and outwardly extending projections or flanges 40 for fitting within the grooves 36.

The split splice assembly 20 which is preferably an aluminum extrusion having a length of about 12 inches and an outer cross section which is complimentary to the inner cross section of a pair of hollow outer extrusions 50.

Figure 3:
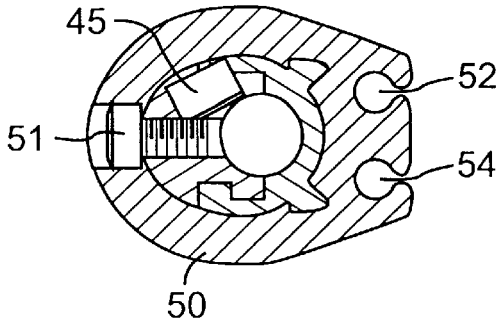
FIG. 3 is a cross sectional view of the splice piece shown in FIG. 2 positioned within an outer extrusion.
Figure 4:
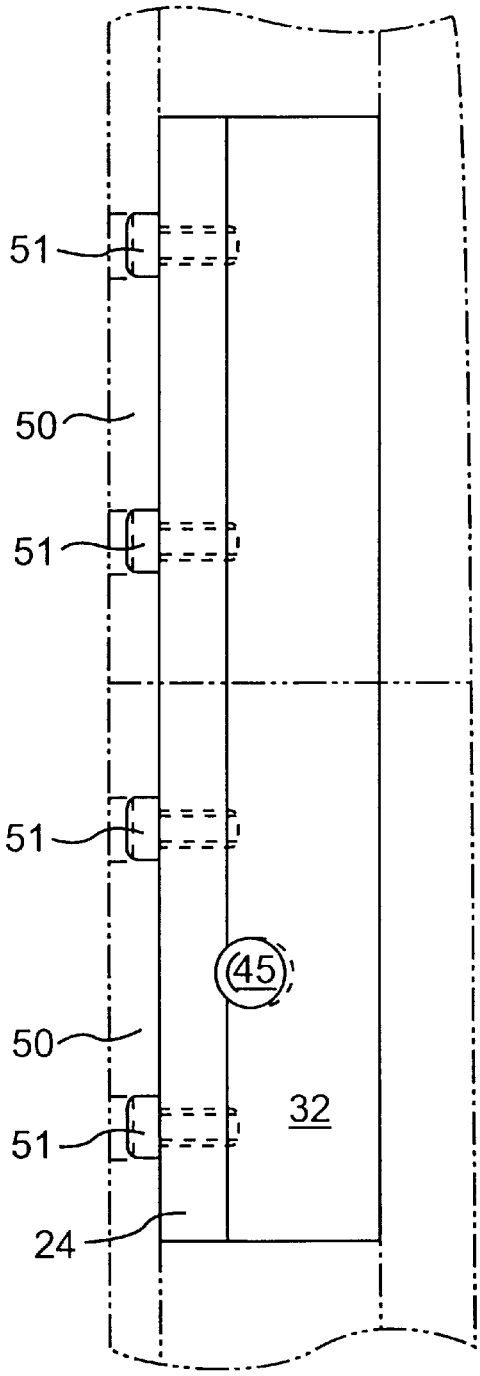
FIG. 4 is a schematic side view which illustrates the assembly of a forward and tail portion of a split splice and outer extrusions in abutting relationship in accordance with a preferred embodiment of the present invention.
Figure 5:
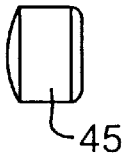
FIG. 5 is a side elevational view of a button for use in maintaining the split splice in an aligned position.

The split assembly 20 also includes a transverse passageway 43 when the nose portion and tail portion are longitudinally aligned with the flanges 40 within grooves 36. A metal button 45 is positioned within the passageway and held in place thereof by one of the outer extrusions 50. This button 45 prevents the tail portion 32 from moving longitudinally i.e. downwardly with respect to the nose portion 24. As shown in FIG. 3 a plurality of screws 51 are threaded into the forward portion 24, through the extrusion 50 to rigidly position the splice assembly in place and to hold the extrusion 50 in a rigid and abutting relationship and at the same time to provide the torsional stability to the furling element.

The outer extrusion 50 also defines a pair of longitudinally extending grooves 52 and 54 as in conventional furlers.

It should be recognized that the furling element will also include a drum or a jib spool and lower bearing assembly as shown in the copending U.S. patent application entitled Roller Furling Apparatus, Ser. No. 08/926,680, filed on Sept. 10, 1997 now U.S. Pat. No. 5,899,163. That application is assigned to the same assignee as the present application and is incorporated herein in its entirety by reference.

We claim:

1. A splice assembly for joining together first and second hollow tubular elements and comprising:

a) a first elongated portion having at least one longitudinal groove extending at least partially along a length of the first portion from one end of the first elongated portion;

b) a second elongated portion having at least one first projection extending at least partially along a length of the second portion and configured to engage the at least one longitudinal groove in the first elongated portion when the first and second portion are moved relative to each other in a longitudinal direction so as to connect the first and second portions together; and c) a locking member engaging the first and second portions when they are connected together, such engagement preventing relative longitudinal movement between the first and second portions, the locking member located such that, when the splice assembly joins the first and second hollow tubular elements together, disengagement of the locking member from the first and second portion is prevented by at least one of the first and second hollow tubular elements.

2. The splice assembly of claim 1 wherein the first elongated portion has at least one second projection wherein the at least one longitudinal groove is located in the at least one second projection.

3. The splice assembly of claim 1 wherein the locking member has a generally cylindrical configuration.

4. The splice assembly of claim 1 wherein the locking member has a substantially circular cross-sectional configuration.

5. The splice assembly of claim 1 wherein the first and second elongated portions have facing surfaces which bound a longitudally extending opening when the first and second portions are connected together.

6. The splice assembly of claim 1 wherein the first elongated portion has two longitudinally extending grooves.

7. The splice assembly of claim 6 wherein the two longitudinally extending grooves open toward each other.

8. The splice assembly of claim 6 wherein the two longitudinally extending grooves open away from each other.

9. The splice assembly of claim 6 further comprising two second projections extending from the first portion, each second projection having therein one of the two longitudinally extending grooves.

10. The splice assembly of claim 9 wherein the second elongated portion has two first projections located such that each of the two first projections engages one of the two longitudinally extending grooves of the first elongated portion.

11. A multi-piece, torsionally stiff furling element comprising:

a) at least two longitudinally extending tubular sections located in an end-to-end, axially aligned, abutting relationship;

b) a longitudinally extending splice assembly disposed within the tubular section at the juncture thereof with a portion of the splice assembly extending into each of the tubular sections, the splice assembly comprising;

i. a first elongated portion having at least one longitudinal groove extending at least partially along a length of the first portion from one end of the first elongated portion;

ii. a second elongated portion having at least one first projection extending at least partially along a length of the second portion and configured to engage the at least one longitudinal groove in the first elongated portion when the first and second portions are moved relative to each other in a longitudinal direction so as to connect the first and second portions together; and, iii. a locking member engaging the first and second portions when they are connected together, such engagement preventing relative longitudinal movement between the first and second portions, the locking member located such that, when the splice assembly joins the at least two longitudinally extending tubular sections together, disengagement of the locking member from the first and second portion is prevented by at least one of the at least two longitudinally extending tubular sections; and, c) at least one fastener engaging each tubular section and at least one of the first and second portions of the splice assembly.

12. The furling element of claim 11 wherein the first elongated portion has at least one second projection wherein the at least one longitudinal groove is located in the at least one second projection.

13. The furling element of claim 11 wherein the locking member has a generally cylindrical configuration.

14. The furling element of claim 11 wherein the locking member has a substantially circular cross-sectional configuration.

15. The furling element of claim 11 wherein the first and second elongated portions have facing surfaces which bound a longitudally extending opening when the first and second portions are connected together.

16. The furling element of claim 11 wherein the first elongated portion has two longitudinally extending grooves.

17. The furling element of claim 16 wherein the two longitudinally extending grooves open toward each other.

18. The furling element of claim 16 wherein the two longitudinally extending grooves open away from each other.

19. The furling element of claim 16 further comprising two second projections extending from the first portion, each second projection having therein one of the two longitudinally extending grooves.

20. The furling element of claim 19 wherein the second elongated portion has two first projections located such that each of the two first projections engages one of the two longitudinally extending grooves of the first elongated portion.

21. The furling element of claim 11 wherein an outer surface of the splice assembly has a generally oval cross-sectional configuration.

22. The furling element of claim 21 further comprising at least one longitudinally extending ear extending from the outer surface of the splice assembly.

23. The furling element of claim 22 further comprising two longitudinally extending ears.

24. The furling element of claim 23 wherein the two longitudinally extending ears are located on the second portion of the splice assembly.

* * * * *